US010858780B2

(12) United States Patent
Martin

(10) Patent No.: US 10,858,780 B2
(45) Date of Patent: Dec. 8, 2020

(54) COMPOSITE ELEVATOR SYSTEM TENSION MEMBER

(71) Applicant: Otis Elevator Company, Farmington, CT (US)

(72) Inventor: Kyle B. Martin, Avon, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 140 days.

(21) Appl. No.: 16/045,189

(22) Filed: Jul. 25, 2018

(65) Prior Publication Data

US 2020/0031623 A1 Jan. 30, 2020

(51) Int. Cl.
*D07B 1/02* (2006.01)
*B66B 7/06* (2006.01)

(52) U.S. Cl.
CPC ..... *D07B 1/025* (2013.01); *B66B 7/06* (2013.01); *D07B 2205/2042* (2013.01); *D07B 2501/2007* (2013.01)

(58) Field of Classification Search
CPC ..... B66B 7/06; D07B 1/025; D07B 1/16
See application file for complete search history.

(56) References Cited

U.S. PATENT DOCUMENTS 3,446,002 A * 5/1969 Kippan ..... D07B 1/04 57/234
4,228,641 A * 10/1980 O'Neil ..... D02G 3/38 57/210
4,275,117 A * 6/1981 Crandall ..... A63B 51/02 156/148
4,433,536 A * 2/1984 O'Neil ..... D07B 5/005 57/233
4,510,743 A 4/1985 De Kroon
4,887,422 A 12/1989 Klees et al.
5,060,466 A * 10/1991 Matsuda ..... D07B 1/025 57/12
5,771,673 A * 6/1998 Lorch ..... D07B 1/167 57/234
5,881,843 A 3/1999 O'Donnell et al.
6,148,597 A * 11/2000 Cook ..... D02G 3/40 428/364
6,318,504 B1 11/2001 De Angelis
6,364,063 B1 4/2002 Aulanko et al.
(Continued)

FOREIGN PATENT DOCUMENTS

DE 1269590 B 6/1968
JP 2002060162 A 2/2002
JP 2009001943 A 1/2009

OTHER PUBLICATIONS

European Search Report Issued in EP Application No. 19188445.1, dated Dec. 11, 2019, 48 Pages.

*Primary Examiner* — Shaun R Hurley
(74) *Attorney, Agent, or Firm* — Cantor Colburn LLP

(57) ABSTRACT

A tension element of an elevator system tension member includes a plurality of first polymer fibers of a first material extending along a length of the tension element, and a plurality of second polymer fibers of a second material different from the first material. The plurality of second polymer fibers have a melting point lower than that of the plurality of first polymer fibers. The plurality of second polymer fibers are fused to the plurality of first polymer fibers to serve as a matrix for the plurality of first polymer fibers.

14 Claims, 4 Drawing Sheets

(56) References Cited

U.S. PATENT DOCUMENTS

| | | | | |
|---|---|---|---|---|
| 7,032,371 | B2 | 4/2006 | Smith et al. | |
| 7,147,904 | B1 * | 12/2006 | Crawford | D02G 3/38 428/36.1 |
| 7,568,419 | B2 | 8/2009 | Bosman | |
| 7,757,472 | B2 * | 7/2010 | Dold | B66B 7/06 57/236 |
| 7,784,258 | B2 * | 8/2010 | Hess | D07B 1/02 57/210 |
| 7,823,496 | B2 | 11/2010 | Bosman et al. | |
| 8,181,438 | B2 * | 5/2012 | Cook | A01K 91/00 57/238 |
| 8,881,496 | B2 | 11/2014 | Bosman et al. | |
| 9,816,211 | B2 * | 11/2017 | Wagner | D07B 1/025 |
| 9,828,214 | B2 | 11/2017 | Pelto-Huikko et al. | |
| 9,828,215 | B2 | 11/2017 | Pelto-Huikko | |
| 9,834,409 | B2 | 12/2017 | Kere et al. | |
| 9,834,872 | B2 * | 12/2017 | Tam | A43C 9/00 |
| 9,988,241 | B2 | 6/2018 | Lehtinen | |
| 9,994,424 | B2 | 6/2018 | Kere et al. | |
| 2006/0137896 | A1 * | 6/2006 | O'Donnell | D02G 3/447 174/117 F |
| 2008/0282664 | A1 * | 11/2008 | Chou | D07B 5/12 57/210 |
| 2015/0191332 | A1 | 7/2015 | Kere | |
| 2017/0066630 | A1 | 3/2017 | Gurvich et al. | |
| 2017/0145631 | A1 | 5/2017 | Rommel et al. | |

* cited by examiner

COMPOSITE ELEVATOR SYSTEM TENSION MEMBER

BACKGROUND

Exemplary embodiments pertain to the art of elevator systems. More particularly, the present disclosure relates to tension members of elevator systems.

Elevator systems utilize one or more tension members operably connected to an elevator car and a counterweight in combination with, for example, a machine and traction sheave, to suspend and drive the elevator car along a hoistway. In some systems, the tension member is a belt having one or more tension elements retained in a jacket. In a typical elevator system, the tension elements are one or more steel cords. In some elevator systems, however, especially high rise elevator systems, the weight of the tension member becomes a significant design consideration. As such lighter weight, stiff and high strength tension element configurations are desired to reduce tension member weight while retaining the performance characteristics of a typical tension member having steel cord tension elements.

BRIEF DESCRIPTION

In one embodiment, a tension element of an elevator system tension member includes a plurality of first polymer fibers of a first material extending along a length of the tension element, and a plurality of second polymer fibers of a second material different from the first material. The plurality of second polymer fibers have a melting point lower than that of the plurality of first polymer fibers. The plurality of second polymer fibers are fused to the plurality of first polymer fibers to serve as a matrix for the plurality of first polymer fibers.

Additionally or alternatively, in this or other embodiments the plurality of first polymer fibers and the plurality of second polymer fibers are liquid crystal polymer fibers.

Additionally or alternatively, in this or other embodiments the plurality of first polymer fibers and the plurality of second polymer fibers are different grades of the same base material.

Additionally or alternatively, in this or other embodiments the plurality of first polymer fibers are formed from Vectran® HS and the plurality of second polymer fibers are formed from Vectran® M.

Additionally or alternatively, in this or other embodiments the plurality of first polymer fibers are interwoven with the plurality of second polymer fibers.

Additionally or alternatively, in this or other embodiments the plurality of first polymer fibers are continuous along the length of the tension element.

In another embodiment, a tension member for an elevator system includes one or more tension elements. Each tension element includes a plurality of first polymer fibers of a first material extending along a length of the tension member, and a plurality of second polymer fibers of a second material different from the first material. The plurality of second polymer fibers have a melting point lower than that of the plurality of first polymer fibers. The plurality of second polymer fibers are fused to the plurality of first polymer fibers to serve as a matrix for the plurality of first polymer fibers. A jacket at least partially encloses the one or more tension elements.

Additionally or alternatively, in this or other embodiments the plurality of first polymer fibers and the plurality of second polymer fibers are liquid crystal polymer fibers.

Additionally or alternatively, in this or other embodiments the plurality of first polymer fibers and the plurality of second polymer fibers are different grades of the same base material.

Additionally or alternatively, in this or other embodiments the plurality of first polymer fibers are formed from Vectran® HS and the plurality of second polymer fibers are formed from Vectran® M.

Additionally or alternatively, in this or other embodiments the plurality of first polymer fibers are interwoven with the plurality of second polymer fibers.

Additionally or alternatively, in this or other embodiments the plurality of first polymer fibers are continuous along the length of the tension element.

Additionally or alternatively, in this or other embodiments the tension member includes a plurality of tension elements arrayed across a width of the tension member.

In yet another embodiment, a method of forming a tension member for an elevator system includes arranging a plurality of first polymer fibers of a first material and a plurality of second polymer fibers of a second material different from the first material, applying heat and pressure to the plurality of first polymer fibers and the plurality of second polymer fibers to at least partially melt the plurality of second polymer fibers, and fusing the plurality of second polymer fibers to the plurality of first polymer fibers via the application of heat and pressure, such that the plurality of second polymer fibers serves as a matrix for the plurality of first polymer fibers.

Additionally or alternatively, in this or other embodiments the plurality of first polymer fibers and the plurality of second polymer fibers are at least partially enclosed in a jacket via a jacketing process.

Additionally or alternatively, in this or other embodiments the plurality of second polymer fibers are fused to the plurality of first polymer fibers via the jacketing process.

Additionally or alternatively, in this or other embodiments the plurality of first polymer fibers and the plurality of second polymer fibers are liquid crystal polymer fibers.

Additionally or alternatively, in this or other embodiments the plurality of first polymer fibers and the plurality of second polymer fibers are different grades of the same base material.

Additionally or alternatively, in this or other embodiments the plurality of first polymer fibers are formed from Vectran® HS and the plurality of second polymer fibers are formed from Vectran® M.

Additionally or alternatively, in this or other embodiments the plurality of first polymer fibers are interwoven with the plurality of second polymer fibers.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
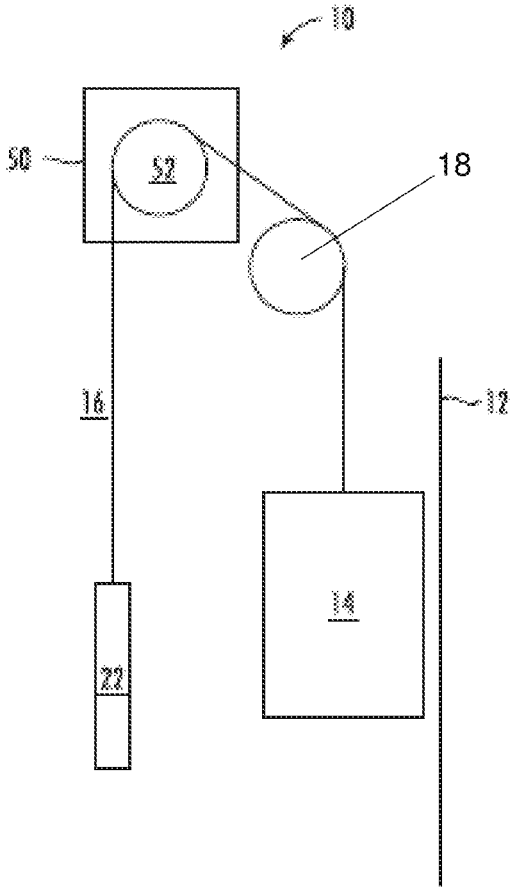
FIG. 1 is a schematic illustration of an elevator system.

Shown in FIG. 1 is a schematic view of an exemplary traction elevator system 10. Features of the elevator system 10 that are not required for an understanding of the present invention (such as the guide rails, safeties, etc.) are not discussed herein. The elevator system 10 includes an elevator car 14 operatively suspended or supported in a hoistway 12 with one or more tension members, for example belts 16. While the following description, belts 16 are the tension members utilized in the elevator system 10, one skilled in the art will readily appreciate that the present disclosure may be utilized with other tension members, such as ropes. The one or more belts 16 interact with sheaves 18 and 52 to be routed around various components of the elevator system 10. Sheave 18 is configured as a diverter, deflector or idler sheave and sheave 52 is configured as a traction sheave, driven by a machine 50. Movement of the traction sheave 52 by the machine 50 drives, moves and/or propels (through traction) the one or more belts 16 that are routed around the traction sheave 52. Diverter, deflector or idler sheaves 18 are not driven by a machine 50, but help guide the one or more belts 16 around the various components of the elevator system 10. The one or more belts 16 could also be connected to a counterweight 22, which is used to help balance the elevator system 10 and reduce the difference in belt tension on both sides of the traction sheave during operation. The sheaves 18 and 52 each have a diameter, which may be the same or different from each other.

In some embodiments, the elevator system 10 could use two or more belts 16 for suspending and/or driving the elevator car 14 In addition, the elevator system 10 could have various configurations such that either both sides of the one or more belts 16 engage the sheaves 18, 52 or only one side of the one or more belts 16 engages the sheaves 18, 52. The embodiment of FIG. 1 shows a 1:1 roping arrangement in which the one or more belts 16 terminate at the car 14 and counterweight 22, while other embodiments may utilize other roping arrangements.

The belts 16 are constructed to meet belt life requirements and have smooth operation, while being sufficiently strong to be capable of meeting strength requirements for suspending and/or driving the elevator car 14 and counterweight 22.

Figure 2:
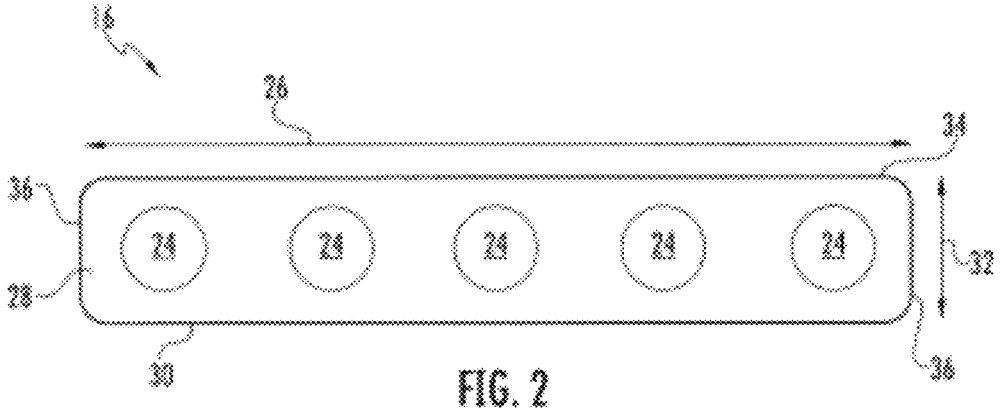
FIG. 2 is a cross-sectional view of an embodiment of an elevator system belt.

FIG. 2 provides a cross-sectional schematic of an exemplary belt 16 construction or design. The belt 16 includes a plurality of tension elements 24 extending longitudinally along the belt 16 and arranged across a belt width 26. The tension elements 24 are at least partially enclosed in a jacket 28 to restrain movement of the tension elements 24 in the belt 16 with respect to each other and to protect the tension elements 24. The jacket 28 defines a traction side 30 configured to interact with a corresponding surface of the traction sheave 52. A primary function of the jacket 28 is to provide a sufficient coefficient of friction between the belt 16 and the traction sheave 52 to produce a desired amount of traction therebetween. The jacket 28 should also transmit the traction loads to the tension elements 24. In addition, the jacket 28 should be wear resistant and protect the tension elements 24 from impact damage, exposure to environmental factors, such as chemicals, for example.

The belt 16 has a belt width 26 and a belt thickness 32, with an aspect ratio of belt width 26 to belt thickness 32 greater than one. The belt 16 further includes a back side 34 opposite the traction side 30 and belt edges 36 extending between the traction side 30 and the back side 34. While five tension members 24 are illustrated in the embodiment of FIG. 2, other embodiments may include other numbers of tension members 24, for example, 6, 10 or 12 tension elements 24. Further, while the tension elements 24 of the embodiment of FIG. 2 are substantially identical, in other embodiments, the tension elements 24 may differ from one another. While a belt 16 with a rectangular cross-section is illustrated in FIG. 2, it is to be appreciated that belts 16 having other cross-sectional shapes are contemplated within the scope of the present disclosure.

Figure 3:
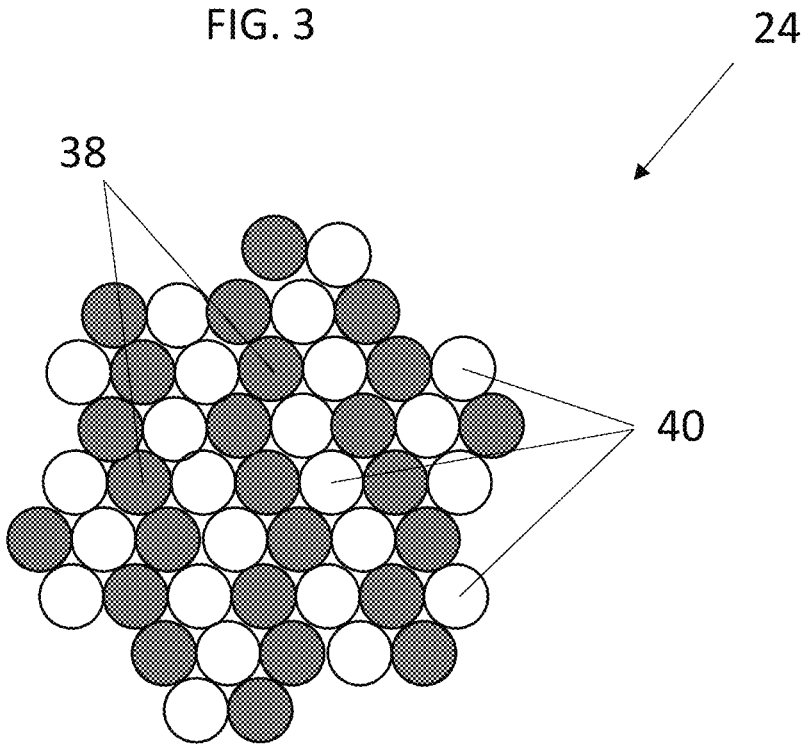
FIG. 3 is a cross-sectional view of an embodiment of a tension element for an elevator belt.

Referring now to FIG. 3, the tension element 24 is formed from a plurality of first polymer fibers 38 interwoven with a plurality of second polymer fibers 40. The plurality of first polymer fibers 38 is, in some embodiments, a first liquid crystal polymer material, such as Vectran®, and the plurality of second polymer fibers 40 is formed from a second liquid crystal polymer material, different from the first liquid crystal polymer material. The plurality of first polymer fibers 38 are fused with the plurality of second polymer fibers 40 when the tension element 24 is subjected to heat and pressure, with the plurality of second polymer fibers 40 acting as a matrix for the tension element 24 to retain and support the load-carrying plurality of first polymer fibers 38. In some embodiments, the plurality of first polymer fibers 38 and/or the plurality of second polymer fibers 40 are continuous along a length of the tension element 24.

This composite structure of the plurality of first polymer fibers 38 and the plurality of second polymer fibers 40 eliminates the need for an epoxy matrix material in the tension element. The plurality of second polymer fibers 40 fuses to the plurality of first polymer fibers 38 under heat and pressure, because the plurality of second polymer fibers 40 has a lower melting point temperature than the plurality of first polymer fibers 38. To fuse the plurality of first polymer fibers 38 and the plurality of second polymer fibers 40, the heat applied is sufficient to melt the plurality of second polymer fibers 40, but not melt the plurality of first polymer fibers 38. In some embodiments, the plurality of first polymer fibers 38 and the plurality of second polymer fibers 40 are formed from two different grades of the same base material. For example, the plurality of first polymer fibers 38 are formed from Vectran® HS and the plurality of second polymer fibers 40 are formed from Vectran® M. While in this embodiment Vectran® is utilized, one skilled in the art will appreciate that other liquid crystal polymer materials may be utilized. Further, it is to be appreciated that other polymers, such as nylon or dyneema, may be utilized.

Figure 2A:
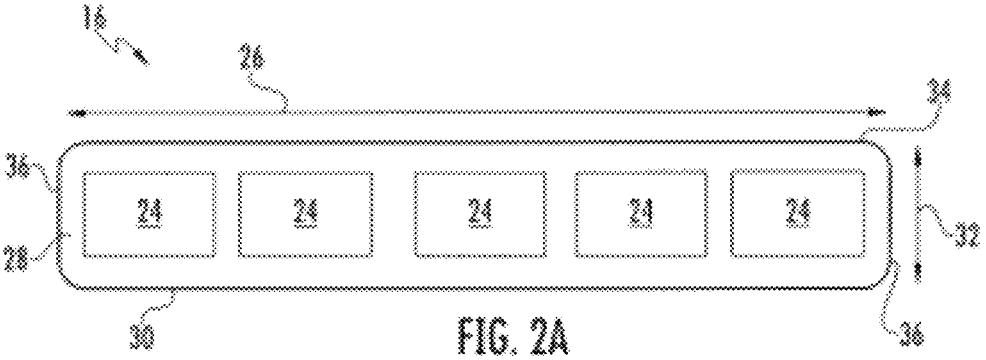
FIG. 2A is another cross-sectional view of an embodiment of an elevator system belt.

While a circular cross-sectional tension element geometry is illustrated in the embodiment of FIG. 3, other embodiments may include different tension element cross-sectional geometries, such as rectangular (shown in FIG. 2A) or ellipsoidal. While the cross-sectional geometries of the tension elements 24 in FIG. 2 are shown as identical, in other embodiment the tension elements' cross-sectional geometries may differ from one another.

Figure 4:
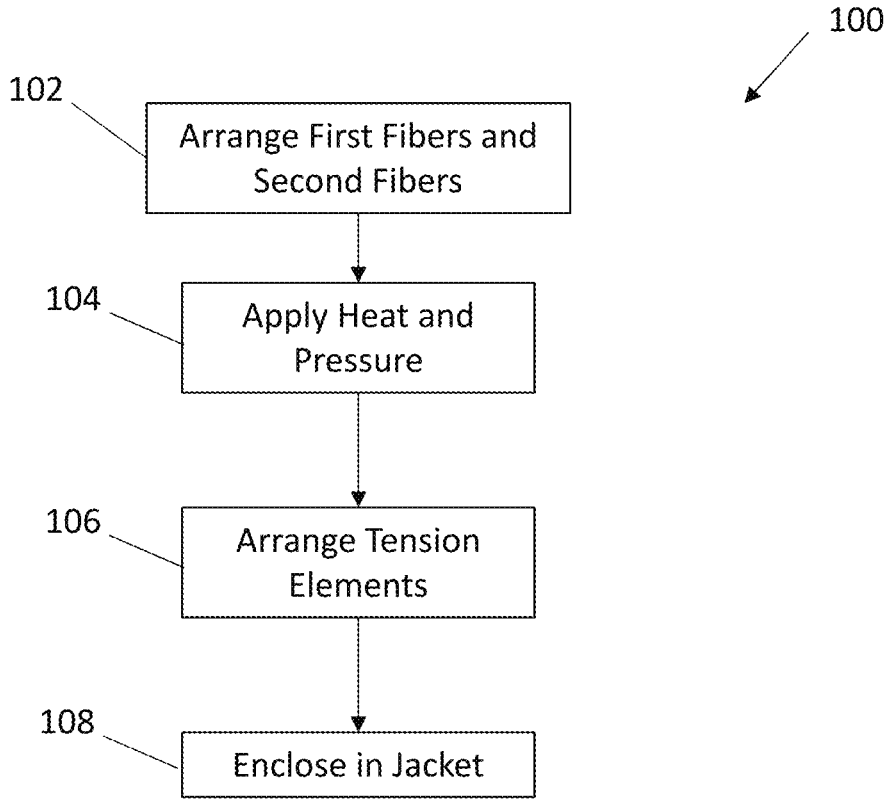
FIG. 4 is a schematic view of a method of forming an elevator belt.

Referring now to FIG. 4, illustrated is a method 100 of forming a tension member for an elevator system 10, for example, a belt 16. At step 102, the plurality of first polymer fibers 38 are interwoven with the plurality of second polymer fibers 40 into a tension element 24. One skilled in the art will readily appreciate that other processes, such as twisting, braiding, or the like, mat be utilized to intermingle the plurality of first polymer fibers 38 and the plurality of second polymer fibers 40. At step 104, heat and pressure is applied sufficient to at least partially melt the plurality of second polymer fibers 40 and fuse the plurality of second polymer fibers 40 to the plurality of first polymer fibers 38. At step 106, a plurality of tension elements 24 are arranged into selected positions for the belt 16, and at step 108 the plurality of tension elements 24 are subjected to a jacketing process at which the jacket 28 is formed over the plurality of tension elements 24. While in one embodiment, the plurality of second polymer fibers 40 is fused to the plurality of first polymer fibers 38 at step 104, it is to be appreciated that in other embodiments the fibers 40 and 38 may be fused at the jacketing process of step 108.

The tension elements 24 disclosed herein of the plurality of first polymer fibers 38 and the plurality of second polymer fibers 40 results in a relatively low weight and high strength tension element 24 for use in, for example, high rise elevator systems 10.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A tension element of an elevator system tension member, comprising:

a plurality of first polymer fibers of a first material extending along a length of the tension element; and a plurality of second polymer fibers of a second material different from the first material, the plurality of second polymer fibers having a melting point lower than that of the plurality of first polymer fibers;

wherein the plurality of second polymer fibers are fused to the plurality of first polymer fibers to serve as a matrix for the plurality of first polymer fibers;

wherein the plurality of first polymer fibers and the plurality of second polymer fibers are liquid crystal polymer fibers.

2. The tension element of claim 1, wherein the plurality of first polymer fibers and the plurality of second polymer fibers are different grades of the same base material.

3. The tension element of claim 1, wherein the plurality of first polymer fibers are interwoven with the plurality of second polymer fibers.

4. The tension element of claim 1, wherein the plurality of first polymer fibers are continuous along the length of the tension element.

5. A tension member for an elevator system, comprising:

one or more tension elements, each tension element including:

a plurality of first polymer fibers of a first material extending along a length of the tension member; and a plurality of second polymer fibers of a second material different from the first material, the plurality of second polymer fibers having a melting point lower than that of the plurality of first polymer fibers;

wherein the plurality of second polymer fibers are fused to the plurality of first polymer fibers to serve as a matrix for the plurality of first polymer fibers; and a jacket at least partially enclosing the one or more tension elements;

wherein the plurality of first polymer fibers and the plurality of second polymer fibers are liquid crystal polymer fibers.

6. The tension member of claim 5, wherein the plurality of first polymer fibers and the plurality of second polymer fibers are different grades of the same base material.

7. The tension member of claim 5, wherein the plurality of first polymer fibers are interwoven with the plurality of second polymer fibers.

8. The tension member of claim 5, wherein the plurality of first polymer fibers are continuous along the length of the tension element.

9. The tension member of claim 5, wherein the tension member includes a plurality of tension elements arrayed across a width of the tension member.

10. A method of forming a tension member for an elevator system, comprising:

arranging a plurality of first polymer fibers of a first material and a plurality of second polymer fibers of a second material different from the first material;

applying heat and pressure to the plurality of first polymer fibers and the plurality of second polymer fibers to at least partially melt the plurality of second polymer fibers; and fusing the plurality of second polymer fibers to the plurality of first polymer fibers via the application of heat and pressure, such that the plurality of second polymer fibers serves as a matrix for the plurality of first polymer fibers;

wherein the plurality of first polymer fibers and the plurality of second polymer fibers are liquid crystal polymer fibers.

11. The method of claim 10, further comprising at least partially enclosing the plurality of first polymer fibers and the plurality of second polymer fibers in a jacket via a jacketing process.

12. The method of claim 11, wherein the plurality of second polymer fibers are fused to the plurality of first polymer fibers via the jacketing process.

13. The method of claim 10, wherein the plurality of first polymer fibers and the plurality of second polymer fibers are different grades of the same base material.

14. The method of claim 10, wherein the plurality of first polymer fibers are interwoven with the plurality of second polymer fibers.

* * * * *